US007432792B2

(12) United States Patent
Renaud et al.

(10) Patent No.: US 7,432,792 B2
(45) Date of Patent: Oct. 7, 2008

(54) HIGH FREQUENCY THIN FILM ELECTRICAL CIRCUIT ELEMENT

(75) Inventors: Philippe Renaud, Tournefeuille (FR); Ramamurthy Ramprasad, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 112 days.

(21) Appl. No.: 10/596,044

(22) PCT Filed: Nov. 29, 2004

(86) PCT No.: PCT/EP2004/013645

§ 371 (c)(1),
(2), (4) Date: Aug. 25, 2006

(87) PCT Pub. No.: WO2005/052961

PCT Pub. Date: Jun. 9, 2005

(65) Prior Publication Data

US 2007/0159285 A1 Jul. 12, 2007

(30) Foreign Application Priority Data

Nov. 28, 2003 (EP) ..... 03292965

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 6,114,937 A 9/2000 Burghartz et al.
6,593,841 B1 7/2003 Mizoguchi et al.
2002/0005565 A1 1/2002 Forbes et al.
2002/0008605 A1 1/2002 Gardner
2002/0048668 A1 4/2002 Inoue

FOREIGN PATENT DOCUMENTS

JP 59144105 A * 8/1984

OTHER PUBLICATIONS

Zhuang et al; "Ferromagnetic RF inductors and transformers for standard SMOS/BiCMOS" IEEE Technical Digest, USA, Dec. 2002.
Fergen et al; "Soft ferromagnetic thin films for high frequency applications" Journal of Magnetism and Magnetic Materials, Amsterdam, NL, vol. 242-245, Apr. 2002.
O'Reilly et al; "New integrated planar magnetic cores for inductors and transformersfabricated in MCM-L technology"; International Journal of Microcircuits and electronic Packaging, US vol. 23, No. 1 Jan. 2000.

* cited by examiner

*Primary Examiner*—Anh T Mai

(57) ABSTRACT

An electrical inductor circuit element comprising an elongate electrical conductor coupled magnetically with thin layers of magnetic material extending along at least a part of the conductor above and below the conductor. The aspect ratio of the thickness of each of the layers of magnetic material to its lateral dimensions is between 0.001 and 0.5 and is preferably between 0.01 and 0.1. This range of aspect ratio has a high ferromagnetic resonance frequency.

The inductor preferably includes magnetic interconnections extending beside the conductor and interconnecting the layers of magnetic material at positions where magnetic flux generated by electrical current flowing along the conductor is transverse to the layers.

16 Claims, 4 Drawing Sheets

HIGH FREQUENCY THIN FILM ELECTRICAL CIRCUIT ELEMENT

FIELD OF THE INVENTION

This invention relates to a high frequency thin film electrical circuit element comprising an elongate conductor coupled magnetically with at least one layer of magnetic material extending along at least a part of the conductor above and below the conductor.

BACKGROUND OF THE INVENTION

Embedding or sandwiching the conductor of an inductive element in a magnetic material can significantly increase its inductance at a given size or reduce its size while maintaining a given inductance. Similarly, embedding or sandwiching a conductor in a magnetic material can improve containment of the magnetic field generated by current flowing along the conductor: this may be especially valuable if the conductor is formed as part of a semiconductor device such as an integrated circuit, since it can improve signal isolation from other elements of the device.

A reduction in circuit element size is especially valuable for microscopic circuit elements made using semiconductor-type manufacturing techniques such as mask-controlled deposition and etching of materials on a support layer, since it leads to a reduction in occupied chip area which enables more devices to be produced for a given sequence of manufacturing operations and a given overall support layer ('wafer') size.

However, ferromagnetic resonance (FMR) losses have restricted the applicability of such devices to below 1 GHz, even using high resistivity ferromagnetic materials.

A report entitled "Soft ferromagnetic thin films for high frequency applications" by Fergen, I. et al. in the Journal of Magnetism and Magnetic Materials vol. 242-245 p. 146-51 April 2002 describes a study of the properties of sputtered thin films of magnetic material at high frequencies.

A report entitled "Ferromagnetic RF inductors and transformers for standard CMOS/BiCMOS" by Zhuang Y et al. in the International Electron Devices Meeting 2002 Technical Digest, IEEE 8 Dec. 2002 p. 475-478 describes an RF inductor comprising an elongate electrical conductor coupled magnetically with a thin layer of magnetic material extending along at least part of the conductor above and below the conductor, the layer having a thickness of 0.5 μm and a lateral dimension of 100, 200, 400 or 800 μm.

A need exists for a practical high frequency thin film electrical circuit element for high frequency applications that has a small occupied chip area.

SUMMARY OF THE INVENTION

The present invention provides an inductive element incorporating carefully chosen layers of magnetic material and a method of making an inductive element as described in the accompanying claims.

DETAILED DESCRIPTION OF THE PREFERRED EMBODIMENTS

Figure 1:
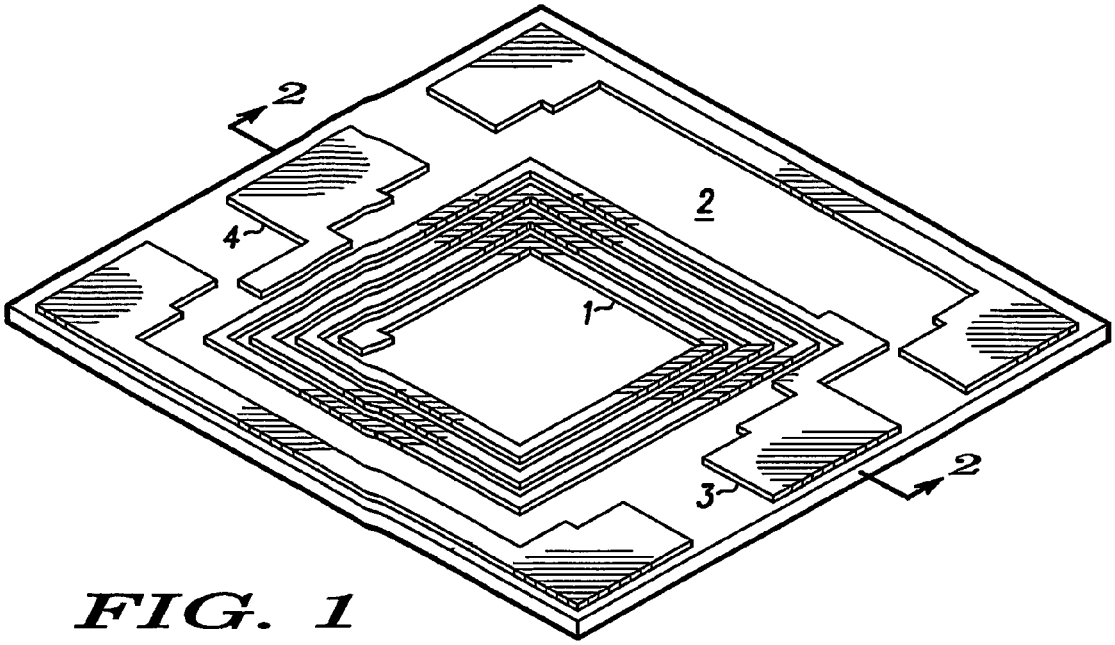
FIG. 1 is a perspective view of an electrical conductor for a high frequency thin film inductor in accordance with one embodiment of the invention, given by way of example.

The embodiment of the invention shown in the drawings comprises an elongated conductor 1 formed in a layer of conductive material on an electrically insulating support layer 2. The electrical conductor 1 may consist of a single straight element, or a series of parallel straight elements connected at alternate ends to the adjacent elements so as to form a meander, or could be part of a planar or non-planar spiral inductor. In the embodiment of the invention shown in FIG. 1, the conductor forms a spiral of generally square shape, having three and a half turns in this example, although fewer or more turns may be provided. An electrical contact pad 3 is formed in the same layer as the conductor 1 and provides a connection to one end of the conductor 1 for external circuit components. An electrical contact pad 4, also formed in the same layer as the conductor 1, is connected to the opposite end of the conductor 1 via a conductive bridge element (not shown) passing underneath the support layer 2.

The conductor 1 may be used as a self-inductance, or as part of a transformer. In order to increase the inductance of the conductor 1, it is embedded in a layer of thin film magnetic material of permeability greater than 1, preferably ferromagnetic material. (Note: the magnetic material is not shown in FIG. 1, although it is shown in other Figures). The lateral dimensions of the conductor 1 extend parallel to and within the lateral dimensions of the magnetic layer 5. The magnetic layer 5 also has the characteristic of containing the magnetic flux from the conductor 1 to a large extent, improving shielding of the conductor 1 and electromagnetic isolation of the signals flowing in the conductor. This property is particularly valuable where the conductor 1, with its magnetic layer 5, is disposed on a common support layer in proximity with other electrical components and, in some cases, it is possible for the conductor 1 to be part of an integrated circuit in which the support layer 2 is also part of the integrated circuit.

In one embodiment of the invention, the magnetic material 5 is a sputtered film of highly resistant ferromagnetic material of suitable thickness. Suitable ferromagnetic materials are alloys such as FeCoSiB and FeTaN.

In another embodiment of the invention, the material of the magnetic layer 5 is a composite material that comprises particles of ferromagnetic material densely packed in a substantially non-magnetic, electrically resistive matrix material. Such composite materials present reduced eddy current losses and the inductor presents reduced series resistance and reduced parasitic capacitance leading to high quality factor ("QS") at high RF frequencies. The magnetic particles may be magnetic nanoparticles of iron (Fe) or iron cobalt (FeCo) alloys. The matrix material may be an organic resin or ligant.

Figure 3:
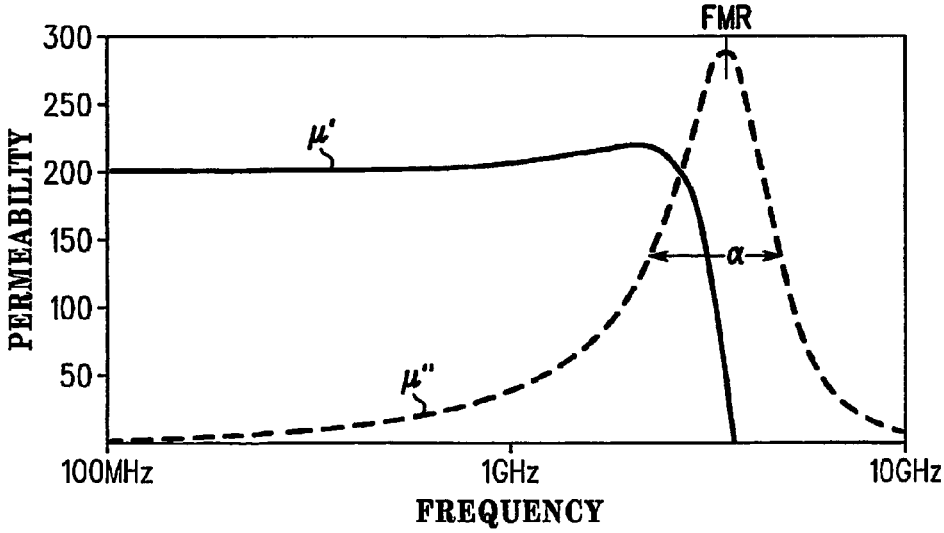
FIG. 3 is a graph of the real and imaginary parts of the permeability as a function of frequency of a ferromagnetic material used in the inductor of FIG. 1.

Typical permeability characteristics of the layer 5 are shown in FIG. 3. The permeability is a complex value, comprising a real part μ' and an imaginary part μ". At frequencies of the order of 1 GHz and higher, such materials exhibit ferromagnetic resonance ("FMR"), at which the real part of the permeability drops rapidly and may go negative, and the imaginary part peaks. These characteristics limit the function of the circuit element to frequencies lower than the FMR frequency.

The permeability of the magnetic layer 5 depends upon its saturation magnetisation, Ms, which is an element for property of the magnetic material, and the anisotropy, Hk, which depends on the crystal structure and morphology of the layer. In both bulk and thin film configurations, the permeability of the material is as follows:

$$\mu=1+Ms/Hk \qquad \text{Equation 1}$$

Figure 4:
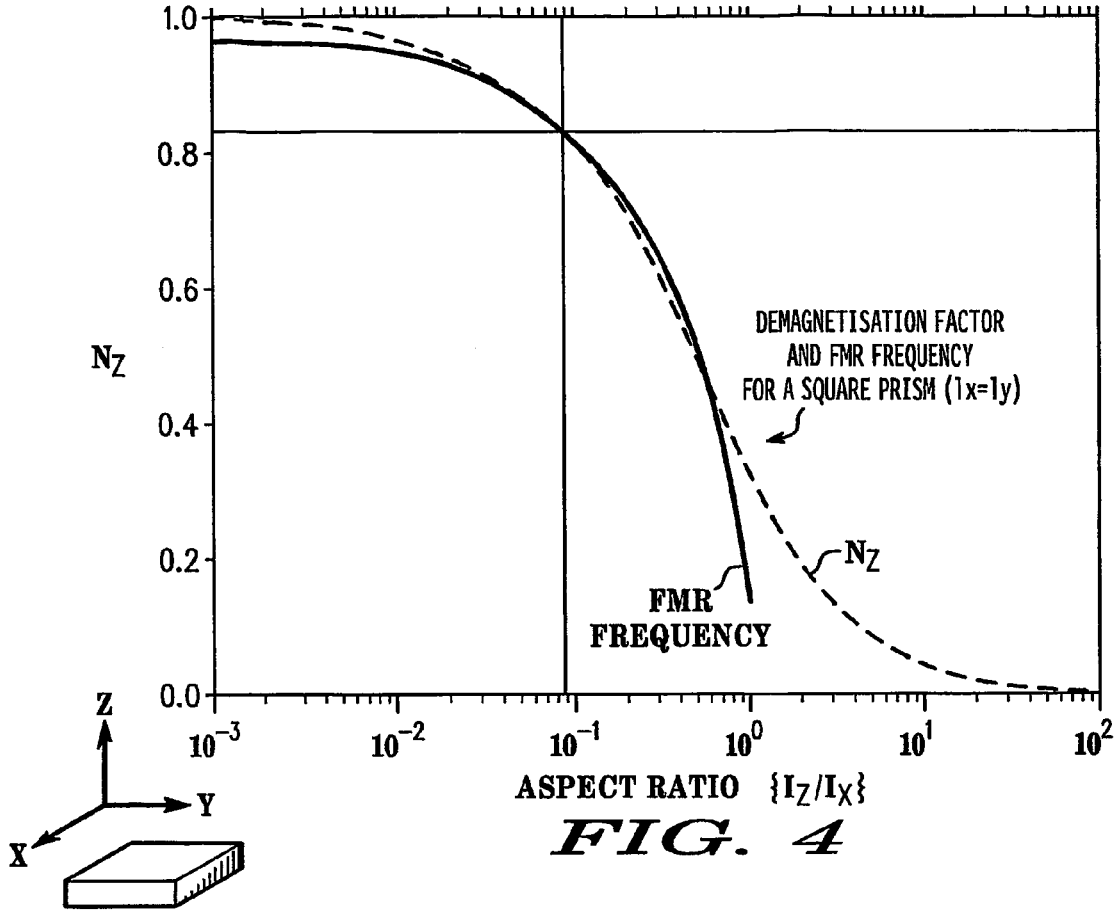
FIG. 4 is a graph of the demagnetisation factor and the ferromagnetic resonance frequency ('FMR') as a function of an aspect ratio of a ferromagnetic material used in the inductor of FIG. 1.

As shown in FIG. 4, it has been found that the ferromagnetic resonance frequency FMR of the layer 5, as well as the demagnetisation factor Nz, are a function of the aspect ratio of the layer 5, that is to say the ratio of the thickness of the layer 5 in the direction Z to its dimensions laterally in the direction of the axes X and Y.

The demagnetization factors are in general a diagonal tensor function of the sample shape. Their impact on the ferromagnetic resonance can be expressed as follow:

$$FMR=\gamma\sqrt{[H_k+(N_y-N_z)M_s][H_k+(N_x-N_z)M_s]}$$

where γ is the gyromagnetic ratio, Nx, Ny, Nz are the demagnetization factors of the particle and Ms the saturation magnetization, Hk is the crystal anisotropy field.

The demagnetization factors are calculated as: Nx+Ny+Nz=1 with their individual expressions for rods and ellipsoid widely calculated and tabulated (see for instance Modern Magnetic Materials, Principles and Application, R. C. O'Handley Wiley Interscience p. 41)

For thin films, Ny=Nz=0; Nx=1 and $FMR=\gamma\sqrt{H^2_k+H_kM_s}\approx\gamma\sqrt{H_kM_s}$ if Ms>>Hk For spheres: Nx=Ny=Nz=⅓ and $FMR=\gamma H_k$ For intermediates configurations the Nz and FMR are dependent on the sample shape (aspect ratio) as depicted in FIG. 4.

As shown in FIG. 4, for aspect ratios of 0.5 and above, the ferromagnetic resonance frequency falls sharply. In preferred embodiments of the invention, the aspect ratio is maintained substantially below 0.5 and preferably below 0.1. It will be seen that, for the example of magnetic material illustrated, the ferromagnetic resonance frequency is 1.5 GHz in bulk material but is approximately 5 GHz at an aspect ratio of 0.5 and exceeds 8 GHz at an aspect ratio of 0.1.

Figure 2:
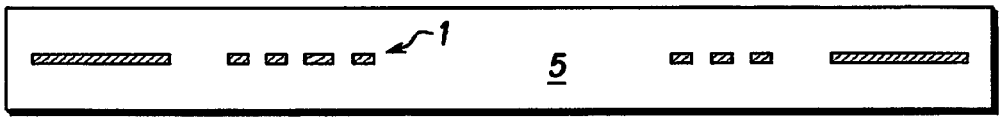
FIG. 2 is a sectional view of the inductor of FIG. 1.

Nonetheless, there is a lower limit to the useful aspect ratio of the layer 5. The smaller the aspect ratio for a given thickness of the layer, the wider are its lateral dimensions. For an example of an inductance of the order of 1 to 5nH at frequencies above 1 GHz and a practical example of the layer 5 with permeability μ of the order of 10, the thickness of the layer 5 of FIG. 2 is of the order of 120 microns. The acceptable size of the lateral dimensions of the circuit element will depend on its application. However, for many applications, lateral dimensions of the order of 12 mm, will be unacceptable, corresponding to an aspect ratio less than 0.01. Moreover, it will be appreciated that, even for reduced thicknesses of magnetic material that lead to reduced lateral dimensions, the improvement in FMR frequency obtained by reducing the aspect ratio gives diminishing returns at ratios much below 0.01, as shown in FIG. 4. Accordingly, even in these embodiments of the invention, the aspect ratio is greater than 0.001.

In fact, the dimensions of the inductor will depend not only on the aspect ratio of the magnetic material but also on its permeability: magnetic materials may be used exhibiting permeability substantially greater than the value of 10 given for a typical material that is currently readily available.

Figure 5:
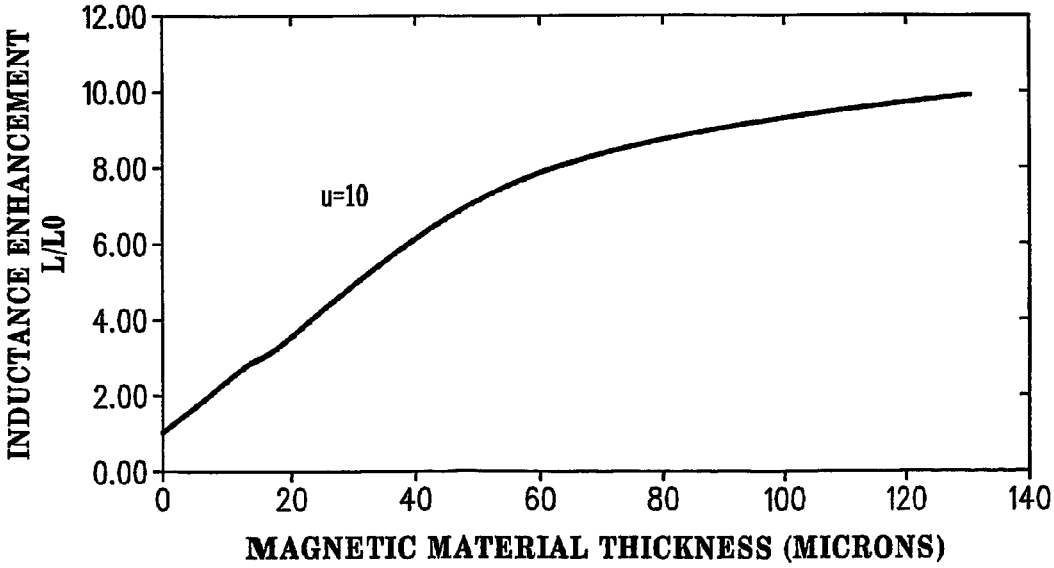
FIG. 5 is a graph of the relative value of the inductance of the inductor of FIG. 1 as a function of the thickness of the magnetic material.
Figure 6:
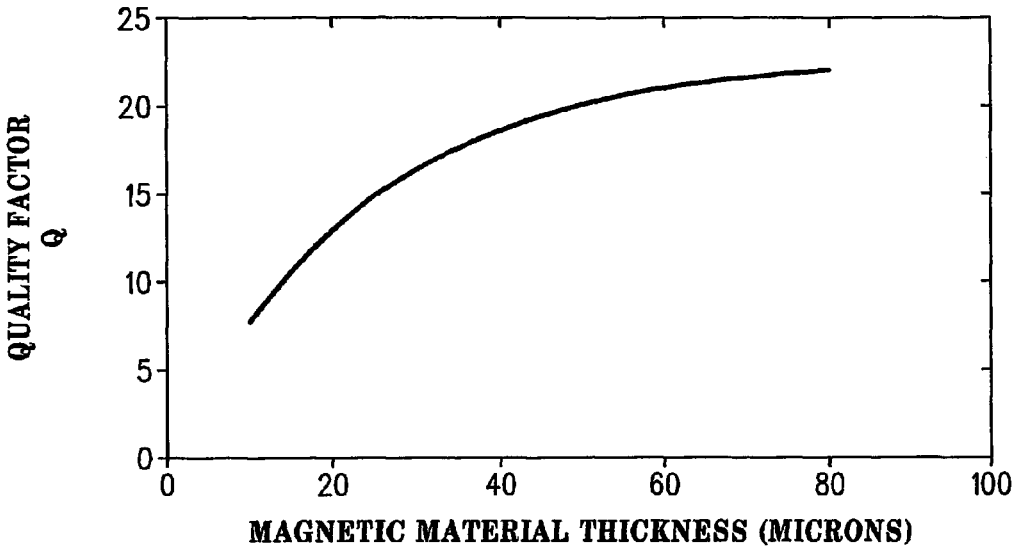
FIG. 6 is a graph of the relative value of the quality factor of the inductor of FIG. 1 as a function of the thickness of the magnetic material.

The inductance of the conductor 1 embedded in the layer 5 relative to the same conductor surrounded by air ("LO") is shown in FIG. 5 as a function of the magnetic material thickness. The quality factor of the inductor presented by the circuit element is shown as a function of thickness in FIG. 6. It will be seen that, in this example, with a permeability of 10, a magnetic material thickness of 60 microns leads to an eightfold increase in inductance compared to an air core conductor 1 and a threefold increase in the quality factor Q.

Figure 7:
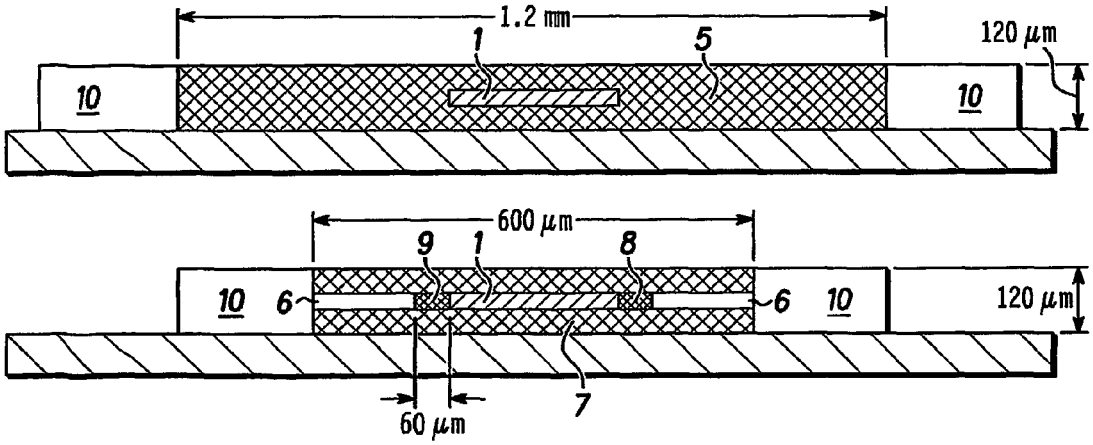
FIG. 7 is a more detailed sectional view of parts of two high frequency thin film inductors in accordance with further embodiments of the invention, given by way of example.

FIG. 7 illustrates another embodiment of the present invention, in which the electrical conductor 1 is sandwiched between a pair of magnetic layers 6 and 7 on the support layer 2, instead of being embedded in a single layer 5. In the example shown in the upper part of FIG. 7, similar to the embodiment of FIG. 2, the layer 5 has a thickness of 120 microns and, with an aspect ratio of 0.1, has lateral dimensions of 1.2 mm. In the embodiment of the invention shown in the lower part of FIG. 7, with two layers 6 and 7, for the same overall thickness of 120 microns, and for an aspect ratio less than 0.1 for each of the layers 6 and 7, the lateral dimensions of the layers 6 and 7 are of the order of 600 microns. In this embodiment of the invention, the layers 6 and 7 are interconnected magnetically by magnetic interconnections 8 and 9 extending on each side of the conductor 1 along substantially all its length. A typical lateral dimension for the magnetic interconnections 8 and 9 is 60 microns. It will be appreciated that FIG. 7 shows views in cross-section of the conductor 1. In each case, the layers 5, 6 and 7 of magnetic material as well as the magnetic interconnections 8 and 9 are bounded by dielectric material 10.

It will be appreciated that current flowing along the conductor 1, that is to say perpendicular to the plane of the drawing, will generate magnetic flux circularly around the conductor and accordingly contained in the transverse extent of the layers 6 and 7 and in the interconnections 8 and 9.

It will be appreciated that the embodiment shown in the lower part of FIG. 7 with two magnetic layers 6 and 7 offers an improvement in aspect ratio for each of the layers for a given lateral dimension compared to the embodiment shown in the upper part of FIG. 7. A further improvement in aspect ratio of the magnetic layers may be obtained as shown in FIG. 8 for elongate conductors that are part of a spiral inductor by adding a further magnetic layer 11 above the magnetic layer 6 and a further magnetic layer 12 below the magnetic layer 7, the layers 6, 7, 11 and 12 being separated by dielectric material 10 as before.

Figure 8:
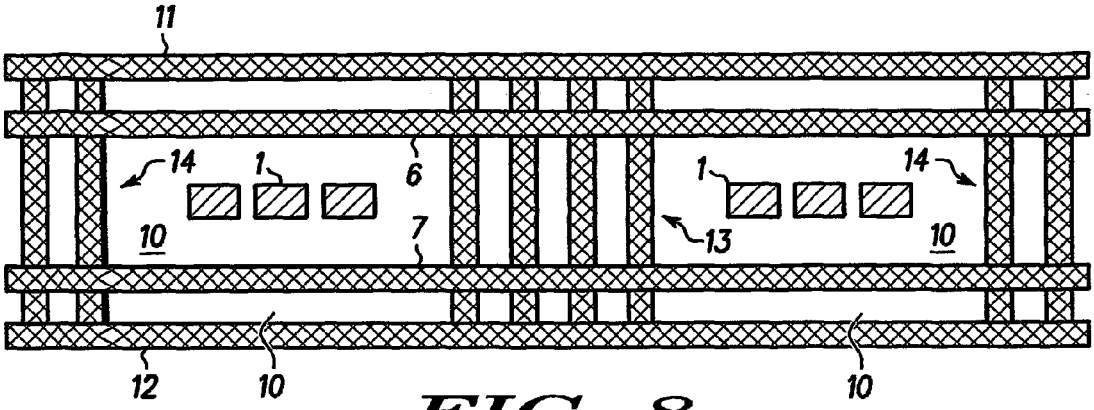
FIG. 8 is a more detailed sectional view of a high frequency thin film inductor in accordance with another embodiment of the invention, given by way of example.
Figure 9:
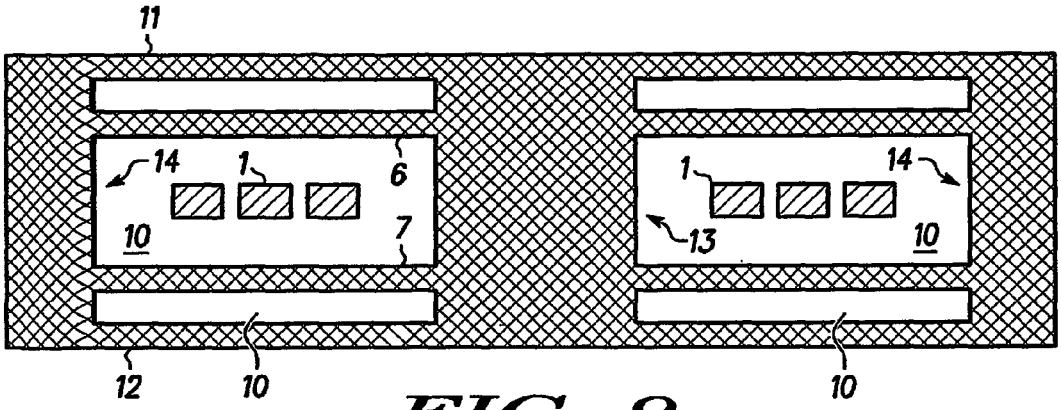
FIG. 9 is a more detailed sectional view of a high frequency thin film inductor in accordance with yet another embodiment of the invention, given by way of example.

As shown in FIG. 8, the magnetic interconnections 8 and 9 between the superposed magnetic layers 6 and 7 and, in the case of the structure shown in FIG. 8 the layers 11 and 12, need not be disposed immediately next to each turn of the conductor 1, especially in the case of a spiral configuration. In this embodiment of the invention, a magnetic interconnection is made between the layers 6, 7, 11 and 12 within the centre of the spiral of the conductor 1 at 13 and a magnetic interconnection is formed outside this spiral substantially all the way around it, at 14. In this embodiment of the invention, the magnetic connections 13 and 14 are formed by vias, formed by depositing magnetic material into holes etched in the dielectric material 10. In an alternative embodiment shown in FIG. 9, the magnetic interconnections 13 and 14 are formed by plugs in which the magnetic material is grown within apertures in the dielectric 10 in mono-block configuration.

It will be appreciated that the electrical circuit device as shown in the drawings may be used in electrical circuit apparatus together with devices that are responsive to the inductance the electric circuit device presents to a periodic current flowing along the conductor.

The invention claimed is:

1. An electrical circuit element comprising:

an elongate electrical conductor coupled magnetically with at least one thin layer of magnetic material extending along at least a part of said conductor juxtaposed with the conductor, characterised in that the aspect ratio of the thickness of said layer of magnetic material to its lateral dimensions is between 0.01 and 0.5.

2. An electrical circuit element as claimed in claim 1, wherein said aspect ratio is less than 0.1.

3. An electrical circuit element as claimed in claim 1, wherein said part of said conductor is disposed within said layer of magnetic material.

4. An electrical circuit element as claimed in claim 1, wherein said elongate electrical conductor is coupled magnetically with a plurality of said thin layers of magnetic material extending along at least a part of said conductor above and below the conductor, the aspect ratio of the thickness of each of said layers of magnetic material to its lateral dimensions being between 0.01 and 0.5.

5. An electrical circuit element as claimed in claim 4, wherein said aspect ratio is less than 0.1.

6. An electrical circuit element as claimed in claim 4, and including magnetic interconnections extending beside said conductor and interconnecting said layers of magnetic material at positions where magnetic flux generated by electrical current flowing along said conductor is transverse to said layers.

7. An electrical circuit element as claimed in claim 6 wherein the lateral dimensions of said interconnections are small compared to the lateral dimensions of said layers.

8. An electrical circuit element as claimed in claim 4, and including a plurality of said layers of magnetic material extending above said conductor and a plurality of said layers of magnetic material extending below said conductor.

9. An electrical circuit element as claimed in claim 4, wherein said conductor extends in a spiral between said layers of magnetic material.

10. An electrical circuit element as claimed in claim 4, wherein said conductor extends in a meander between said layers of magnetic material.

11. An electrical circuit element as claimed in claim 1, wherein said magnetic material comprises a ferromagnetic material.

12. An electrical circuit element as claimed in claim 1, wherein said magnetic material is a composite material that comprises particles of a magnetic material densely packed in a substantially non-magnetic, electrically resistive matrix.

13. An electrical circuit element as claimed in claim 1, wherein said magnetic material is a sputtered film of highly resistive ferromagnetic material.

14. Electrical circuit apparatus comprising an electrical circuit element as claimed in claim 1 and inductance responsive means responsive to the inductance said electrical circuit element presents to a periodic current flowing in said conductor.

15. Electrical circuit apparatus as claimed in claim 14, wherein said electrical circuit element and said inductance responsive means are disposed on a common support layer.

16. Electrical circuit apparatus as claimed in claim 15, wherein said electrical circuit element and said inductance responsive means are parts of a common integrated circuit.

* * * * *